US010375773B2

(12) United States Patent
Uchida et al.

(10) Patent No.: US 10,375,773 B2
(45) Date of Patent: Aug. 6, 2019

(54) MICROWAVE HEATING APPARATUS

(71) Applicant: SHOWA DENKO K.K., Tokyo (JP)

(72) Inventors: Hiroshi Uchida, Tokyo (JP); Kazuaki Senda, Saitama (JP); Mutsumi Yoshida, Saitama (JP)

(73) Assignee: SHOWA DENKO K.K., Minato-ku, Tokyo (JP)

( * ) Notice: Subject to any disclaimer, the term of this patent is extended or adjusted under 35 U.S.C. 154(b) by 629 days.

(21) Appl. No.: 14/430,598

(22) PCT Filed: Sep. 24, 2013

(86) PCT No.: PCT/JP2013/075738
§ 371 (c)(1),
(2) Date: Mar. 24, 2015

(87) PCT Pub. No.: WO2014/050828
PCT Pub. Date: Apr. 3, 2014

(65) Prior Publication Data

US 2015/0223295 A1 Aug. 6, 2015

(30) Foreign Application Priority Data

Sep. 25, 2012 (JP) ..... 2012-211432

(51) Int. Cl.
*H05B 6/70* (2006.01)
*H05B 6/78* (2006.01)

(52) U.S. Cl.
CPC ..... *H05B 6/707* (2013.01); *H05B 6/705* (2013.01); *H05B 6/78* (2013.01)

(58) Field of Classification Search
CPC ..... H05B 6/705; H05B 6/78; H05B 6/707
(Continued)

(56) References Cited

U.S. PATENT DOCUMENTS 6,717,368 B1 * 4/2004 Sakamoto ..... H01J 37/32192 219/121.36
2002/0050486 A1 5/2002 Ishii et al.
(Continued)

FOREIGN PATENT DOCUMENTS

JP 8-21787 A 1/1996
JP 10-58027 A 3/1998
(Continued)

OTHER PUBLICATIONS

The First Office Action dated Oct. 9, 2015, issued by the State Intellectual Property Office of People's Republic of China in corresponding CN Application No. 201380049589.8.
(Continued)

*Primary Examiner* — Ibrahime A Abraham
*Assistant Examiner* — John J Norton
(74) *Attorney, Agent, or Firm* — Sughrue Mion, PLLC

(57) ABSTRACT

Provided is a microwave heating apparatus capable of effectively preventing the generation of sparks when an object containing a conductor (including a metal precursor such as a metal oxide) or a semiconductor is subjected to microwave heating. A microwave heating apparatus supplies a microwave so that the direction of the electrical flux line of the microwave is identical with the direction substantially parallel with a surface of a plate-like substrate and having thereon a pattern containing a conductor, a metal oxide, or a semiconductor, the substrate being arranged in the waveguide. The microwave heating apparatus also controls a pulse width of the microwave so that pulsed microwaves are supplied to the surface having the pattern thereon.

5 Claims, 3 Drawing Sheets

(58) Field of Classification Search
USPC ..... 219/696
See application file for complete search history.

(56) References Cited

U.S. PATENT DOCUMENTS

| | | | | |
|---|---|---|---|---|
| 2004/0026039 | A1 | 2/2004 | Goto et al. | |
| 2010/0308036 | A1* | 12/2010 | Tomita | H05B 6/6408 219/756 |
| 2013/0134157 | A1* | 5/2013 | Knox | H05B 6/80 219/762 |

FOREIGN PATENT DOCUMENTS

| | | | | |
|---|---|---|---|---|
| JP | 10058027 | A | * | 3/1998 |
| JP | 2002-203844 | A | | 7/2002 |
| JP | 2002203844 | A | * | 7/2002 |
| JP | 2005-49009 | A | | 2/2005 |
| JP | 2007000774 | A | * | 1/2007 |
| JP | 2008247667 | A | * | 10/2008 |
| JP | 2009-177149 | A | | 8/2009 |
| JP | 2009-181900 | A | | 8/2009 |
| JP | 2009-283547 | A | | 12/2009 |
| JP | 2009283547 | A | * | 12/2009 |
| JP | 2011-150911 | A | | 8/2011 |
| WO | 03/036700 | A1 | | 5/2003 |

OTHER PUBLICATIONS

Office Action dated Nov. 17, 2016 from the Intellectual Property Office of Taiwan in counterpart application No. 102134540.
International Search Report for PCT/JP2013/075738 dated Nov. 5, 2013.

* cited by examiner

[FIG. 1]
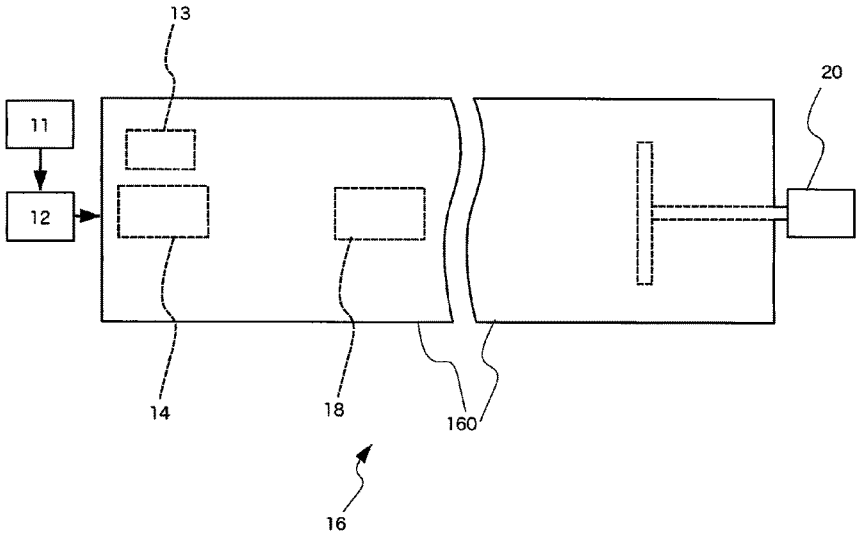
[FIG. 2]
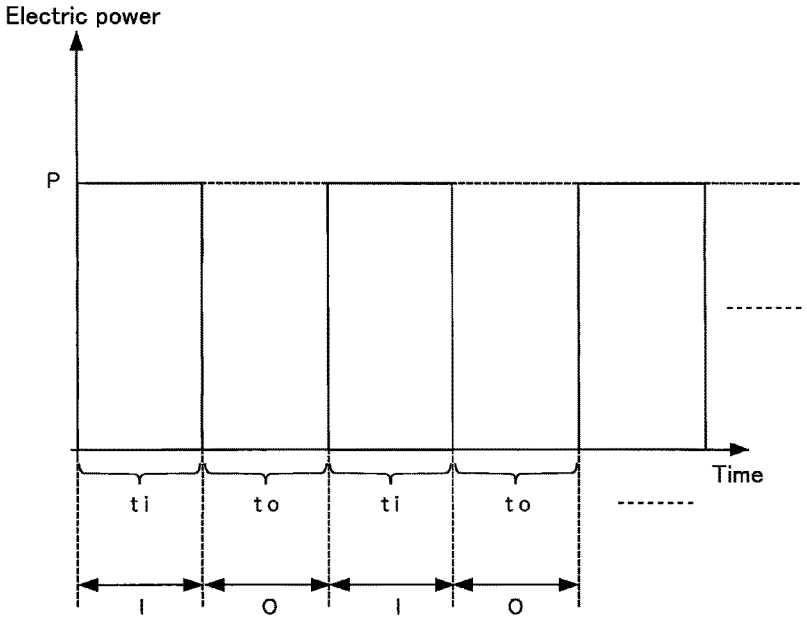

[FIG. 3]
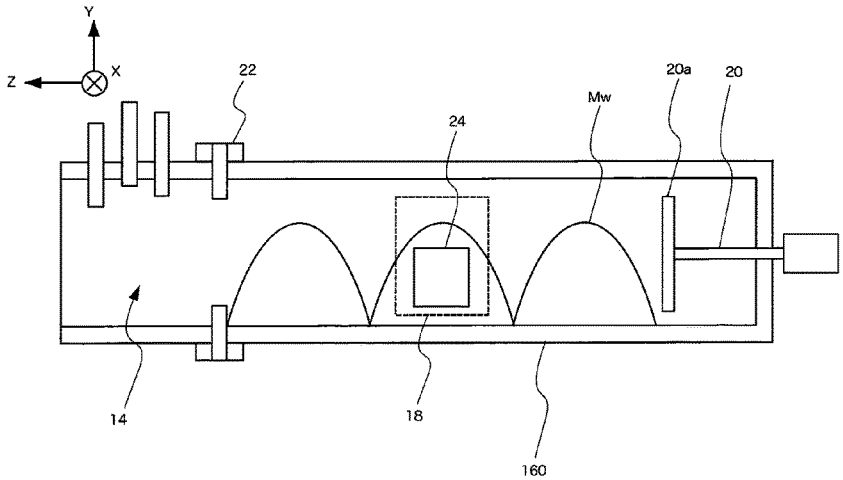
FIG. 4A
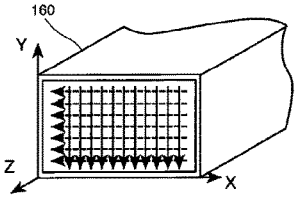
FIG. 4B
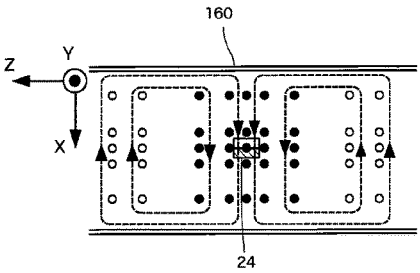
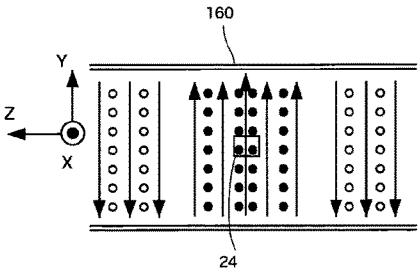
FIG. 4C

[FIG. 5]
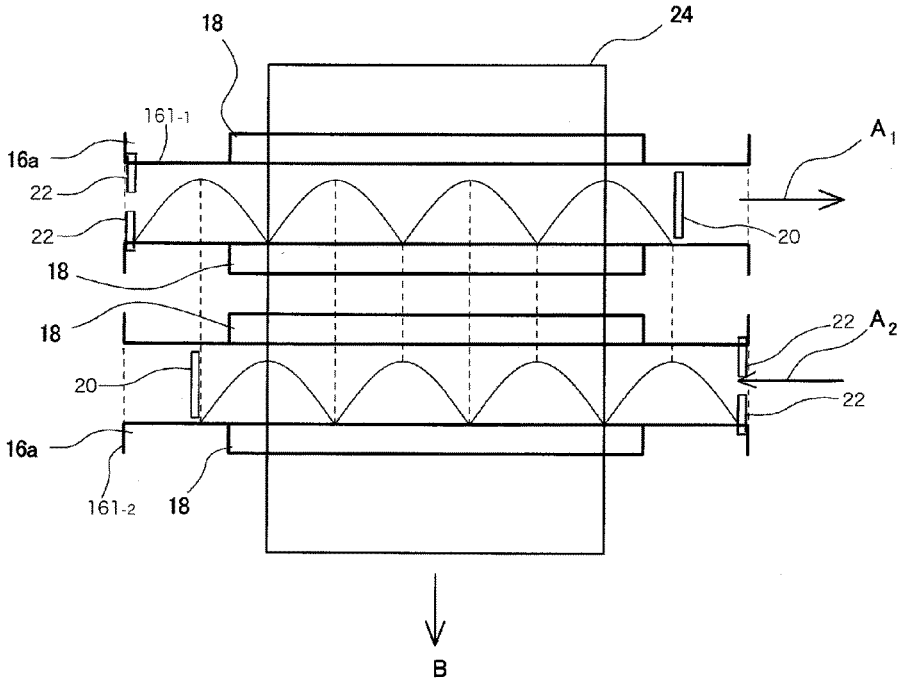

MICROWAVE HEATING APPARATUS

CROSS REFERENCE TO RELATED APPLICATIONS

This application is a National Stage of International Application No. PCT/JP2013/075738 filed Sep. 24, 2013, claiming priority based on Japanese Patent Application No. 2012-211432 filed Sep. 25, 2012, the contents of all of which are incorporated herein by reference in their entirety.

TECHNICAL FIELD

The present disclosure relates to a microwave heating apparatus.

BACKGROUND ART

There is a conventionally known technology for heating a material such as metal or a thin film of such a material by microwave. As an example, as disclosed in Patent Document 1, a thin film formed of an inorganic metal salt which is a precursor of a metal oxide semiconductor, is subjected to microwave irradiation under the atmospheric pressure to convert the thin film to a semiconductor.

Patent Document 2 discloses a technology for promoting densification and crystallization by selective heating of a specific layer on a film substrate, wherein a microwave source is pulse-driven to irradiate pulsed microwave.

PRIOR ART

Patent Document

Patent Document 1: Japanese Unexamined Patent Publication (Kokai) No. 2009-177149

Patent Document 2: Japanese Unexamined Patent Publication (Kokai) No. 2011-150911

SUMMARY

However, the above conventional technologies do not take account of sparks generated when an object containing a conductor or a semiconductor is heated by microwave. When sparks are generated, the object may be accidentally deformed or broken. Therefore, a technology for effectively preventing such deformation or breakage has been desired.

The present disclosure has been made in view of the above drawbacks. One of the objectives of the present disclosure is to provide a microwave heating apparatus capable of effectively preventing generation of sparks when an object containing a conductor or a semiconductor is heated by an electric field of the microwave.

In order to solve the above drawbacks of the prior art, the present disclosure provides a microwave heating apparatus provided with: a waveguide; a microwave supplying device which supplies a microwave so that the direction of the electrical flux line of the microwave is identical with the direction substantially parallel with a surface of a plate-like substrate having thereon a pattern containing a conductor, a metal oxide, or a semiconductor, the substrate being arranged in the waveguide; and a control device which controls a pulse width of the microwave supplying device so that pulsed microwaves are supplied to the surface having the pattern thereon.

According to the present disclosure, the generation of sparks can be effectively prevented when an object containing a conductor (including a metal precursor such as a metal oxide) or a semiconductor is heated by microwave.

BRIEF DESCRIPTION OF DRAWINGS

FIG. 1 is a configuration block diagram showing an example of a microwave heating apparatus according to an embodiment of the present disclosure.

FIG. 2 is an explanatory view showing an example of pulse control of a microwave heating apparatus according to an embodiment of the present disclosure microwave.

FIG. 3 is an explanatory view showing an example of a waveguide constituting a heating unit of a microwave heating apparatus according to an embodiment of the present disclosure.

FIG. 4A is an explanatory view showing an example of electromagnetic field distribution of microwaves generated within a waveguide of a microwave heating apparatus according to an embodiment of the present disclosure.

FIG. 4B is an explanatory view showing an example of electromagnetic field distribution of microwaves generated within a waveguide of a microwave heating apparatus according to an embodiment of the present disclosure.

FIG. 4C is an explanatory view showing an example of electromagnetic field distribution of microwaves generated within a waveguide of a microwave heating apparatus according to an embodiment of the present disclosure.

FIG. 5 is an explanatory view showing another example of a waveguide constituting a heating unit of a microwave heating apparatus according to an embodiment of the present disclosure.

EMBODIMENT

An embodiment of the present disclosure will be explained with reference to the drawings. As exemplified in FIG. 1, a microwave heating apparatus according to an embodiment of the present disclosure comprises a microwave source control unit 11, a microwave generation unit 12, a monitor unit 13, a tuner unit 14, a heating unit 16 including a waveguide 160, a to-be-heated object supplying unit 18, and a movable short circuit unit 20.

The microwave source control unit 11 performs pulse control so that the microwave generation unit 12 intermittently irradiates microwaves. Specifically, as exemplified in FIG. 2, the microwave source control unit 11 alternately repeats an ON period operation (I) to supply power source of a predetermined electric power to the microwave generation unit 12, and an OFF period operation (O) to cutoff the power supply to the microwave generation unit 12, at a predetermined time interval.

According to an example of the present embodiment, the ratio (duty ratio) between the length of the period of the ON period operation ti (second), and the length of the period of the OFF period operation to (second) is 1:1, and the frequency (1/(ti+to)) is 50 kHz. However, the frequency, the duty ratio, and the electric power P to be supplied to the microwave generation unit 12 can be determined depending on the object to be heated, etc.

When the electric power is supplied from the microwave source control unit 11 to the microwave generation unit 12, microwaves to be supplied to the waveguide 160 constituting the heating unit 16 are generated. Here, the microwave is an electromagnetic wave having a wavelength in the range of 1 m to 1 mm (frequency being 300 MHz to 300 GHz). According to the present embodiment, the microwave generation unit 12 introduces the generated microwaves from the iris unit 22 formed at the end in the longitudinal direction of the waveguide 160, into the waveguide 160.

The monitor unit 13 measures the incident power of the microwave generated by the microwave generation unit 12, and the reflection power from the heating unit 16, and outputs the measurement results. The tuner unit 14 generates an electromagnetic wave having a phase anti-phase to the phase of the reflected wave generated when the microwave enters the waveguide 160 of the heating unit 16, to thereby cancel the reflected wave. Thereby, the reflected waves can be prevented from returning to the microwave generation unit 12.

The heating unit 16 comprises a waveguide 160. The heating unit 16 heats an object to be heated arranged in the waveguide 160, by microwaves introduced through the iris unit 22 (refer to FIG. 3) of the waveguide 160. As described below, according to an embodiment of the present disclosure, among the energies of the microwave, the electric field energy is used for heating the object to be heated.

The to-be-heated object supplying unit 18 is provided with a microwave leakage preventing mechanism, and supplies an object to be heated to the waveguide 160 constituting the heating unit 16. The to-be-heated object supplying unit 18 may be, for example, an opening formed on the waveguide 160, for supplying the object to be heated. In this case, the object to be heated is manually inserted into the waveguide 160 through the opening. Further, the object to be heated may be supplied to the waveguide 160 by an appropriated supplying device such as a roll-to-roll device. The object to be heated may have a width of preferably 0.01 to 2 m, more preferably 0.05 to 1.5 m, and most preferably 0.1 to 1 m, where the object to be heated is supplied by the roll-to-roll device.

According to the present embodiment, an example of the object to be heated is an ink layer (a pattern containing a conductor, a metal oxide, or a semiconductor) formed by printing the following ink in a predetermined pattern (including the print over the entirety) on a substrate:

(1) a metal ink containing a conductive material such as Ag, Cu, Al, Ni, Au having an median particle diameter of 20 μm or less (more preferably 10 μm or less) dispersed in an appropriate solvent;

(2) a metal ink having an alloy (solder paste, etc.) containing a conductive material such as Ag, Cu, Al, Ni, Au, dispersed in an appropriate solvent;

(3) an ink composition having an oxide ink and a reducing agent dispersed in an appropriate solvent, the oxide ink being an ink of a material which is originally an insulation material (metal precursor), such as a copper oxide, a nickel oxide, a cobalt oxide (median particle diameter being 10 μm or less, more preferably 1 μm or less); or (4) a semiconductor ink having semiconductor fine particles having an median particle diameter of 20 μm or less (more preferably, 10 μm or less) dispersed in an appropriate solvent (the semiconductor fine particle being a IV-group semiconductor such as Si, Ge, etc., a II-IV-group semiconductor such as ZnSe, CdS, ZnO, etc., and a III-V-group semiconductor such as GaAs, InP, GaN, etc.).

The ink layer (a pattern including a conductor, a metal oxide, or a semiconductor) is formed on a substrate, to have a thickness of 10 nm to 100 μm. If the ink layer is thinner, coating becomes difficult. If the ink layer is thicker, uniform heating becomes difficult. More preferably, the ink layer has a thickness of 10 nm to 10 μm. Here, the material which is originally an insulation material acquires conductivity when the material is heated in the heating unit 16. In the present embodiment, acquiring the conductivity means having a resistivity of $10^3$ Ωcm or less. The median particle diameter is obtained by measuring particle diameters using a laser diffraction particle size distribution measurement device (for example, Microtrac Particle Size Distribution Measurement Device MT3000II Series USVR, manufactured by Nikkiso Co., Ltd.), and performing spherical approximation.

The solvent in which such conductive materials are dispersed may be: a carbonyl compound, such as acetone, methyl ethyl ketone, cyclohexanone, benzaldehyde, octyl aldehyde, etc.; an ester compound, such as methyl acetate, ethyl acetate, butyl acetate, ethyl lactate, methoxyethyl acetate, etc.; a carboxylic acid, such as formic acid, acetic acid, oxalic acid, etc.; an ether compound such as diethyl ether, ethylene glycol dimethyl ether, ethyl cellosolve, butyl cellosolve, phenyl cellosolve, dioxane, etc.; an aromatic hydrocarbon compound such as toluene, xylene, naphthalene, decalin, etc.; an aliphatic hydrocarbon compound such as pentane, hexane, octane, etc.; a halogenated hydrocarbon such as methylene chloride, chlorobenzene, chloroform, etc.; an alcohol compound such as methanol, ethanol, n-propanol, isopropanol, butanol, cyclohexanol, terpineol, ethylene glycol, propylene glycol, glycerin, etc.; water; or a mixture of the above. Among the above solvents, a water-soluble solvent is preferable, and alcohol and water are particularly preferable. If a metal oxide is used as an original substance for a conductive material, using a reducing agent together is preferable. Although the above-mentioned organic solvents have a reduction effect, in view of the reduction efficiency, the use of a polyhydric alcohol such as ethyleneglycol, propyleneglycol, glycerin, etc., or a carboxylic acid such as formic acid, acetic acid, oxalic acid, etc., is preferable.

Further, when printing is performed with such an ink composition, a binder resin may be used for the purpose of adjusting a viscosity, etc. A polymer compound which can be used as a binder resin may be a thermoplastic resin or a thermoset resin which is, for example; a poly-N-vinyl compound such as polyvinylpyrrolidone polyvinyl caprolactone, a polyalkylene glycol compound such as polyethylene glycol, polypropylene glycol, or poly THF, polyurethane, a cellulose compound and a derivative thereof, an epoxy compound, a polyester compound, chlorinated polyolefin, a polyacrylic compound, and the like. All of these binder resins can function as a reducing agent, although the degree of the reduction effect may differ among them. Taking the binder effect into account, polyvinylpyrrolidone is preferable. Taking the reduction effect into account, a polyalkylene glycol compound such as polyethylene glycol, polypropylene glycol, etc., is preferable. Taking the adhesive force as a binder into account, a polyurethane compound is preferable.

The method for forming an ink composition layer is not limited, but the method may be, for example, wet coating. The wet coating means a process to form a film by coating a liquid on a layer to be coated. The wet coating to be used in the present embodiment is not limited and can be any known methods, and thus, spray coating, bar coating, roll coating, die coating, dip coating, drop coating, inkjet coating, screen printing, relief printing, intaglio printing, planographic printing, gravure printing, and the like, may be used.

A movable short circuit unit 20 is arranged within the waveguide 160 so as to be movable in the longitudinal direction thereof, to terminate microwaves within the waveguide 160. Namely, within the waveguide 160, a microwave introduced through an iris unit 22 is reflected and turned back at the position of the movable short circuit unit 20. Thus, if the movable short circuit unit 20 is moved to an appropriate position, the microwave may be made as a standing wave. Specifically, while the reflected power output from a monitor unit 13 is measured, and whether or not a standing wave is formed by the measured reflected power is examined, the movable short circuit unit 20 is moved. Then, the movable short circuit unit 20 is fixed at a position where the standing wave is formed.

According to the present embodiment, the wavelength of the microwave within the waveguide 160 is shortened depending on the material of the object to be heated, and thus, conditions for the standing wave may be changed depending thereon. Therefore, according to the present embodiment, while the reflected power is measured by the monitor unit 13, the movable short circuit unit 20 (in more detail, the tip portion 20*a* thereof) is arranged at a position most appropriate for maintaining the standing wave.

FIG. 3 shows an example of the waveguide 160 constituting the heating unit 16 (TE10 mode cavity resonator). In FIG. 3, the waveguide is provided with the tuner unit 14 on the microwave receiving side. Further, the iris unit 22 is provided at the inlet of the microwaves, and the microwaves are introduced through the opening of the iris unit 22 into the waveguide 160. In FIG. 3, the to-be-heated object supplying unit 18 is shown by a dotted line. In FIG. 3, the wave of the microwave Mw shows an electric field curve (the highest point of wave (amplitude) (highest point of the curve) being the maximum point of the electric field, and the lowest point (the lower limit of the curve) being the minimum point of the electric field).

The waveguide 160 is provided, near an end opposite to the side where the iris unit 22 is located, with the movable short circuit unit 20. Due to the electric field of the microwave Mw present between the iris unit 22 and the movable short circuit unit 20, the to-be-heated object supplied by the to-be-heated object supplying unit 18, i.e., the film formed on the substrate 24, is heated. The range of influence by the electric field may differ depending on the frequency (wavelength) of the microwave, but may be, for example, within approximately +/−15 mm from the maximum point of the electric field, in case of 2.45 GHz (about 148 mm).

In order to generate a standing wave of the microwave Mw between the iris unit 22 and the movable short circuit unit 20, the distance L between the iris unit 22 and the tip portion 20*a* is set to satisfy, $$L=(2n-1)\lambda g/2$$

wherein, λg represents a wavelength of the microwave Mw in the waveguide, n represents a natural number. The microwave generated in the waveguide 160 is not limited to a standing wave, but may be a travelling wave.

FIGS. 4A, 4B, and 4C show explanatory views of the electromagnetic field distributions of the microwaves generated within the waveguide 160. FIG. 4A is a perspective view of the waveguide 160, and the waveguide 160 extends in the direction (z-axis direction) perpendicular to the x-y plane in FIG. 4A. When microwaves are supplied in the waveguide 160, the magnetic field is generated in the x-axis direction (the direction perpendicular to the y-z plane). The dotted arrows show the magnetic field lines representing the magnetic field of this case. The electric field is generated in the y-axis direction to be perpendicular to the magnetic field, and the electrical flux lines are shown by the solid arrows.

FIG. 4B is a cross-sectional view of the waveguide 160 cut in a plane parallel with the x-z plane. In FIG. 4B, electrical flux lines of the microwaves are expressed by open circles (○) and closed circles (•). The open circle is an electrical flux line extending from the front side to the rear side of the sheet, and the closed circle is an electrical flux line extending from the rear side to the front side of the sheet. Further, magnetic flux lines are expressed by dotted lines.

As shown in FIG. 4B, the substrate 24 may be arranged in the waveguide 160 or moved within the waveguide 160, in a way so that the surface of the substrate on which a conductor film or a film dispersed with conductors is formed, is maintained to be substantially parallel with the electric field direction of the microwave (direction of the electrical flux line). Thereby, the film may be subjected to induction heating by the electric field. Here, substantially parallel means that the surface of the substrate 24 is in parallel with the electric field direction of the microwave, or the angle between the surface of the substrate 24 and the electric field direction of the microwave is maintained within 30 degrees. The angle within 30 degrees means that the angle between the normal line standing on the surface of the substrate 24 and the direction of the electric field is 60 degrees or more. Further, the arrangement position or the movement position of the substrate 24 in the waveguide 160 is a position including the center of the microwave electric field vortex (a position including the point having the maximum electric field, namely, the point having the densest electrical flux lines).

FIG. 4C is a cross-sectional view of the waveguide 160 cut in a plane parallel with the y-z plane. In FIG. 4C, magnetic flux lines of the microwaves are expressed by open circles (○) and closed circles (•). The open circle is a magnetic flux line extending from the front side to the rear side of the sheet, and the closed circle is a magnetic flux line extending from the rear side to the front side of the sheet.

The substrate 24 is preferably arranged, or passed through an area where the electrical flux lines are dense in the waveguide 160, namely a position including the maximum point of the microwave electric field. Where the electric field is maximum, the magnetic field is minimum.

FIG. 4B and FIG. 4C show cross-sectional views of the substrate 24 on which a conductor film or a film dispersed with conductors is formed. In FIG. 4B and FIG. 4C, the substrate 24 is provided, at least on one surface thereof, with a conductor film or a film dispersed with conductors.

The microwave heating apparatus according to the present embodiment is constituted as above. The microwave source control unit 11 performs pulse control of the microwaves generated by the microwave generation unit 12, to supply pulsed microwaves to the substrate 24, i.e., an object to be heated, arranged within the waveguide 160 of the heating unit 16. According to the present embodiment, the movable short circuit unit 20 within the waveguide 160 is moved to form a standing wave such that the center of the substrate 24 is located at a position approximately same as the point where the microwave electric field is maximum. Thereby, the substrate 24, i.e., the object to be heated, may be heated by pulsed microwaves.

According to the present embodiment, the object to be heated may be a conductive pattern including metal nanowires deposited on the substrate. A transparent conductive film is produced by irradiating the pulsed microwaves to the metal nanowires, to thereby join the intersections of the metal nanowires. Here, joining means that the material (metal) of the nanowires absorbs the irradiated pulsed light at the intersecting portions of the metal nanowires, internal heat generation occurs more efficiently at the intersecting portions, and thus, the intersecting portions are welded.

By this joining, the contact area between nanowires increases at the intersecting portion, leading to the decrease of surface resistance. Accordingly, intersecting portions of the metal nanowires are joined by the pulsed light irradiation, and thereby, a conductive layer having metal nanowires in a mesh shape can be formed. Therefore, the conductivity of the transparent conductive film can be increased, and the surface resistance value of the transparent conductive film according to the present embodiment becomes 10 Ω/sq to 800 Ω/sq. With respect to the mesh formed by the metal nanowires, a closely-spaced mesh is not preferable, because if the space is not enough, the light transmittance may be decreased.

Here, the metal nanowire is a rod-shaped or string-shaped particle which is made of metal and which has a nanometer-sized diameter. In the present embodiment, the metal nanowire cannot be a branched shape, or a shape as if spherical particles are beaded.

The material for the metal nanowire is not limited, and may be, for example, iron, cobalt, nickel, copper, zinc, ruthenium, rhodium, palladium, silver, cadmium, osmium, iridium, platinum, or gold. In view of the high conductivity, copper, silver, platinum, and gold are preferable, and silver is more preferable. The metal nanowire (silver nanowire) preferably has a diameter of 10 to 300 nm and a length of 3 to 500 μm, and more preferably has a diameter of 30 nm to 100 nm and a length of 10 to 100 μm. If the diameter is too small, strength is not enough when the nanowires are joined, whereas if the diameter is too large, the transparency may be decreased. If the length is too short, intersecting portions cannot be effectively overlapped, whereas if the length is too long, the printing property may be decreased.

The metal nanowire may be synthesized by a known method. For example, a method for reducing silver nitrate in a solution may be used. A specific method for reducing silver nitrate in a solution may be a method for reducing a nanofiber made of metal-complex peptide lipid, a method for reducing silver nitrate by heating in ethylene glycol, a method for reducing silver nitrate in a solution of sodium citrate, and the like. Among these methods, the method for reducing silver nitrate by heating in ethylene glycol is preferable because the metal nanowire can be produced most easily.

The method to deposit metal nanowires on a substrate is not limited, but the method may be, for example, wet coating. The wet coating means a process to form a film by coating a liquid on the substrate. The wet coating to be used in the present embodiment is not limited and can be any known methods, and thus, spray coating, bar coating, roll coating, die coating, inkjet coating, screen coating, dip coating, drop coating, relief printing, intaglio printing, gravure printing, and the like, may be used. Further, subsequent to the wet coating, a process to remove the used solvent by heating the substrate, a process to wash away additives such as a dispersant, and the like, may be included. Further, the wet coating may be performed not only once, but also repeatedly for a plurality of times. Also, the pattern printing can be performed by gravure printing or screen printing.

The solvent to be used for the wet coating may be, for example, a ketone compound such as acetone, methyl ethyl ketone, cyclohexanone; an ester compound such as methyl acetate, ethyl acetate, butyl acetate, ethyl lactate, methoxyethyl acetate; an ether compound such as diethyl ether, ethylene glycol dimethyl ether, ethyl cellosolve, butyl cellosolve, phenyl cellosolve, dioxane; an aromatic hydrocarbon compound such as toluene, xylene; an aliphatic hydrocarbon compound such as pentane, hexane; a halogenated hydrocarbon such as methylene chloride, chlorobenzene, chloroform; an alcohol compound such as methanol, ethanol, n-propanol, isopropanol; water; and a mixing solvent of any of above. Among the aforementioned solvents, a water-soluble solvent is preferable, and particularly, alcohol and water are preferable.

Further, according to the present embodiment, the object to be heated may be a predetermined printed pattern (including the print over the entirety) formed by printing a composition containing flat-shaped metal oxide particles (hereinafter, referred to as flat metal oxide particles) and a reducing agent, on the substrate. The pattern itself is not conductive, but when the pattern is irradiated with pulsed microwaves and heated, a sintered body of the metal is generated, and the pattern becomes a conductive pattern. The flat metal oxide particles are used to form a predetermined print pattern on the substrate by, for example, screen printing, gravure printing, etc., using a printing device such as an inkjet printer, or to form a layer of the composition over the entirety of the substrate. The flat metal oxide particles and the substrate as a whole are to be subjected to heating as an object to be heated.

The flat metal oxide particle has a thickness of 10 nm to 800 nm, preferably 20 nm to 500 nm, more preferably 20 nm to 300 nm. A particle thinner than 10 nm is difficult to be prepared, and a particle thicker than 800 nm is not easily sintered. Further, an aspect ratio (width/thickness of the particle) should be large enough to obtain an effect of enlarging the contact area. However, if the aspect ratio is too large, the degree of precision in printing is decreased, and the dispersion of the particles cannot be performed well. Thus, the aspect ratio is in the range of preferably 5 to 200, and more preferably 5 to 100. The shape of the flat metal oxide particle is obtained by measuring the thickness and the width of each particle at ten different observation points using SEM observation at ×30000 magnification. As to the thickness, the number average thickness is obtained.

The flat metal oxide particle may be a copper oxide, cobalt oxide, nickel oxide, iron oxide, zinc oxide, indium oxide, tin oxide, etc. Among these, in view of the high conductivity of the reduced metal, copper oxide is more preferable. In view of other physical properties such as a magnetic property, etc., cobalt oxide is more preferable.

Further, the flat metal oxide particle may be an oxide having various oxidation states, such as the particle may be a copper (I) oxide or a copper (II) oxide, having an oxidation state different from each other.

In addition, a particle of the above metal oxide having a different shape, such as a spherical shape, a rod shape, etc., and a metal particle such as copper, cobalt, nickel, iron, zinc, indium, tin, and an alloy of some of these, may be used together. In this case, the flat metal oxide particles are contained preferably 70% by mass or more, more preferably 80% by mass or more, of the total particles.

According to the present embodiment, a composition in which flat metal oxide particles having a flat shape and a reducing agent are mixed, is subjected to heating by pulsed microwaves. Thereby, a sintered body of a metal can be efficiently produced, and a conductive film having a sufficiently low resistance can be formed.

The conductive pattern forming composition according to the present embodiment is mainly composed of flat metal oxide particles, and in order to form a conductive pattern by pulsed microwave heating, the composition contains a reducing agent. The reducing agent may be an alcohol compound, such as methanol, ethanol, isopropyl alcohol, butanol, cyclohexanol, and terpineol; polyhydric alcohol, such as ethylene glycol, propylene glycol, and glycerin; a carboxylic acid, such as formic acid, acetic acid, oxalic acid, and succinic acid; a carbonyl compound, such as acetone, methyl ethyl ketone, cyclohexane, benzaldehyde, and octyl aldehyde; an ester compound, such as ethyl acetate, butyl acetate, and phenyl acetate; and a hydrocarbon compound, such as hexane, octane, naphthalene, and decalin. Among those mentioned above, polyhydric alcohol, such as ethylene glycol, propylene glycol, glycerin and the like, and carboxylic acid, such as formic acid, acetic acid, and oxalic acid are preferable in view of the efficiency of a reducing agent. The mixing amount of the reducing agent is not limited as far as the amount is enough for reducing the flat metal oxide particles. Usually, the reducing agent also functions as a solvent for a composition containing a binder resin, and thus, the content of the reducing agent is 20 to 200 parts by mass relative to 100 parts by mass of the flat metal oxide particles.

At the time of printing a composition mainly composed of the above flat metal oxide particles, a binder resin is usually used. A polymer compound which can be used as a binder resin may be a thermoplastic resin or a thermoset resin, which is, for example, a poly-N-vinyl compound such as polyvinylpyrrolidone, polyvinyl caprolactam, a polyalkylene glycol compound such as polyethylene glycol, polypropylene glycol, poly THF, polyurethane, a cellulose compound and a derivative thereof, an epoxy compound, a polyester compound, chlorinated polyolefin, and a polyacrylic compound. The above binder resins also function as a reducing agent, although the degree of the effect as the reducing agent may be different. Among the above, polyvinylpyrrolidone and a polyurethane compound are preferable in view of the binder effect, whereas polyalkylene glycol such as polyethylene glycol, polypropylene glycol, etc., is preferable in view of the reduction effect. Polyalkylene glycol such as polyethylene glycol, polypropylene glycol, etc., is classified as a polyhydric alcohol and particularly exhibits a preferable property as a reducing agent.

As mentioned above, in order to print a conductive pattern forming composition mainly composed of flat metal oxide particles, a binder resin is usually used. However, there are drawbacks that if too much binder resin is used, conductivity is not easily expressed, and if too little binder resin is used, the ability to join the particles is reduced. Therefore, preferably 1 to 50 parts by mass, more preferably 3 to 20 parts by mass of the binder resin should be used, relative to 100 parts by mass of the flat metal oxide particles. As mentioned above, the binder resin also functions as a reducing agent. Thus, the reducing agent which does not serve as the binder resin is not an indispensable component of the conductive pattern forming composition according to the present disclosure. However, the mixing amount of the binder resin is small and insufficient in terms of the function as a reducing agent, a reducing agent capable of functioning as a solvent for the binder resin can be used together, within the range satisfying the above mixing ratio.

Depending on the printing method, the conductive pattern forming composition mainly composed of the flat metal oxide particles may further comprise a known organic solvent, aqueous solvent, etc., in accordance with needs, for the purpose of viscosity adjustment, etc., of the composition.

Further, the conductive pattern forming composition used in the present embodiment may further comprise a known ink additive (an antifoaming agent, a surface conditioner, a thixotropic agent, etc.), in accordance with needs.

According to the present embodiment, pulsed microwaves are used, and thus, less energy is used compared with the case where continuous waves are used. Further, the temperature increase occurs in pulsed form, and thus, for example, when the substrate 24 is a film substrate, the substrate is heated at a temperature intermittently exceeding 120 degrees. Therefore, the substrate is less damaged, compared to the case where a continuous wave is used for heating and the substrate is heated at a temperature exceeding 150 degrees for a long time.

FIG. 5 shows an example of the waveguide 161 (TE10 mode cavity resonator) constituting the heating unit 16 according to another example of the microwave heating apparatus of the present embodiment. In FIG. 5, the waveguide 161 comprises an even number of (a plurality of pairs of) waveguides 161-1, 161-2, . . . . Each waveguide **161-*i* (i=1, 2, . . . ) is arranged in the direction parallel with the travelling direction of the microwave, to be juxtaposed in the direction perpendicular to the travelling direction of the microwave. Here, there is at least one pair of adjacent waveguides 161-(2*n*−1), 161-2*n*** (wherein, n is a natural number).

Here, the description of "travelling direction of the microwave" does not mean that the microwave is not a standing wave. The standing wave is generated by synthesizing travelling waves travelling in mutually opposite directions.

Each waveguide 161 is provided on one side, in the microwave travelling direction, with an iris unit 22, and on the other side with a movable short circuit unit 20. The microwave generated by the microwave generation unit 12 is introduced through the iris unit 22 into the waveguide 161.

In this example of the present embodiment, phases of the microwaves in the adjacent waveguides 161 are maintained to be deviated 90 degrees from each other. Specifically, in this example, for example, in order to generate a standing wave of the microwave Mw between the iris unit 22 and the movable short circuit unit 20, the distance L between the iris unit 22 and the tip portion **20*a* of the movable short circuit unit 20** is set to satisfy, $$L=(2n-1)\lambda g/2$$

(wherein, λg represents a wavelength of the microwave Mw within the waveguide, and n represents a natural number). Alternatively, in order to generate a travelling wave, the distance L between the iris unit 22 and the tip portion **20*a* is set to a value different from the value satisfying the above condition. The positions of the iris unit 22 and the movable short circuit unit 20 in the waveguide 161-(2*n*−1), i.e., odd-numbered waveguide, are set to have half-wavelength deviation from the positions thereof in the waveguide 161-2*n* (even-numbered waveguide). Thereby, the phases of the microwaves in the odd-numbered waveguide 161-(2*n*−1) and the even-numbered waveguide 161-2*n* are maintained to be deviated 90 degrees from each other. Accordingly, the phases of the microwaves in the adjacent waveguides 161** are maintained to be deviated 90 degrees from each other.

The object to be heated is moved through a to-be-heated object supplying unit 18 defining a pair of openings formed on each waveguide **161-*i* for supplying and discharging the object to be heated, so that the object to be heated passes through the inside of each waveguide 161-*i* (i=1, 2, . . . ), sequentially. The to-be-heated object supplying unit 18** may be provided with a microwave leakage prevention mechanism.

Namely, in the example shown in FIG. 5, the to-be-heated object supplying unit 18 is provided. The substrate 24 is moved to sequentially pass through the inside of the waveguides 16, by a substrate holding and moving device (not shown), while the surface of the substrate 24 having thereon a conductor or semiconductor film or a film having conductors or semiconductors dispersed therein, is maintained to be substantially parallel with the direction of the electrical flux line of the microwave in each waveguide 161-*i*. Here, sequentially passing through the waveguides means that the substrate 24 passes through one waveguide 161-*i*, and thereafter, the substrate 24 continuously passes through the adjacent waveguide 161-(*i*+1), the microwave phase in the waveguide 161-*i* being deviated 90 degrees from the microwave phase in the waveguide 161-(*i*+1). In the example of FIG. 5, the substrate 24 is moved in the direction from the upper side to the lower side in the drawing (the direction of arrow B).

In the example of FIG. 5 of the present embodiment, microwaves are supplied from alternate directions between the adjacent waveguides in the plurality of waveguides 161. Namely, the positions of the iris unit 22 and the movable short circuit unit 20 are arranged to be alternate between the odd-numbered waveguide 161-(2*n*−1) and the even-numbered waveguide 161-2*n*. In FIG. 5, the odd-numbered waveguide 161-1 is provided on its left side in the figure with the iris unit 22 and on its right side with the movable short circuit unit 20, and the microwave is supplied toward the right side in the figure (A1). The even-numbered waveguide 161-2 is provided on its right side in the figure with the iris unit 22 and on its left side with the movable short circuit unit 20, and the microwave is supplied toward the left side in the figure (A2).

EXAMPLES

Example 1

A polyimide film, Kapton (registered trademark) 150EN (film thickness: 37.5 μm), manufactured by Du Pont-Toray Co., Ltd., was used for the substrate. Silver (Ag) paste (DOTITE (registered trademark) FA-353N, Ag content: 69% by mass, manufactured by Fujikura Kasei Co., Ltd.) was coated on a surface of the substrate. The silver paste was coated by printing a 2 cm square pattern on the substrate by screen printing. The printed pattern (silver paste layer) after being dried for one day at a room temperature, had a thickness of 6 μm (3-point average value). The thickness of the pattern was measured by a digital micrometer manufactured by Mitutoyo Corporation. The change in thickness before and after the pattern formation was measured.

The substrate provided with the silver paste layer formed thereon by coating the silver paste as above, was adhered on a quartz glass (25 mm×100 mm×1 $mm^t$) using Kapton (registered trademark) tape, and arranged in the apparatus shown in FIG. 1, so that, as mentioned above, the silver paste layer coated on the polyimide film surface was arranged in the direction substantially in parallel with the direction of the electrical flux line of the microwave, and at a position satisfying the condition shown in FIG. 4(*b*), i.e., at a position including the maximum point of the microwave electric field.

The microwave used in Example 1 had a frequency of 2.457 GHz, output power of 150 W, a pulse cycle of 50 kHz, and a duty ratio (the ratio of microwave irradiation time "ti" to pulse cycle time "to": ti/(ti+ to)) of 20%. At this time, the maximum point of the electric field (minimum point of the magnetic field) is, theoretically, located at a position λg/4 distant from the iris unit 22 (a position −λg/4 distant from the maximum point of the magnetic field). However, when the substrate 24 is set, wavelength shortening occurs in the microwave moving within the substrate, and thus, the resonance position is moved. Therefore, a microwave detector was arranged at the minimum point of the electric field, λg/2 distant from the iris unit 22, and the position of the plunger was fine-adjusted at a position where the voltmeter located within the waveguide and connected to the microwave detector showed a minimal voltage value.

Table 1 shows the results of the surface temperatures of the silver paste layer before the heating (heating time of 0 second), and after the heating time of 30 seconds, 60 seconds, 90 seconds, and 120 seconds, respectively, the temperatures being measured by a radiation thermometer (TMH91, manufactured by Japan Sensor Corporation).

TABLE 1

| Time (second) | Temperature (° C.) |
|---|---|
| 0 | 28 |
| 30 | 71 |
| 60 | 93 |
| 90 | 106 |
| 120 | 115 |

After the heating for 120 seconds, the surface temperature of the silver paste layer was raised to approximately 115° C. During the microwave heating, no sparks were generated, and the silver film could be formed on the surface of the substrate while the substrate could be prevented from being broken. The silver film had a thickness of 5 μm. The volume resistivity of the obtained silver film, measured by using Loresta-GP (MCP-T610), manufactured by Mitsubishi Chemical Analytech Co., Ltd., was $4.3\times10^{-5}$ Ω·cm.

Comparative Example 1

A silver paste layer was formed on the substrate as in Example 1. The apparatus shown in FIG. 1 was used, but the microwave source control unit 11 did not perform pulse control, and thereby, continuous waves of the microwave were irradiated to the silver paste layer. In this case, same as above, the substrate was arranged so that the surface of the substrate coated with the silver paste was substantially parallel with the direction of the microwave electrical flux line, and was located at the position including the maximum point of the microwave electric field.

The microwave used in Comparative Example 1 had a frequency of 2.457 GHz, and output power of 90 W. The microwaves were supplied not in the pulsed form, but in the continuous form. As a result, sparks were generated immediately after the start of heating, and the substrate was broken.

Example 2

A polyimide film, Kapton (registered trademark) 150EN (film thickness: 37.5 μm), manufactured by Du Pont-Toray Co., Ltd., was used for the substrate. A copper oxide (40 to 60% by mass) paste containing a reducing agent (ethylene glycol, 5 to 15% by mass) (Metalon ICI-020, manufactured by NovaCentrix) was coated on a surface of the substrate. The copper oxide paste was coated by printing a 2 cm square pattern on the substrate by screen printing. The printed pattern (copper oxide paste layer) after being dried for one day at a room temperature, had a thickness of 8 μm (3-point average value), when the thickness was measured in the same way as in Example 1.

The microwave used in Example 2 had a frequency of 2.457 GHz, output power of 60 W, a pulse cycle of 50 kHz, and a duty ratio (the ratio of microwave irradiation time "ti" to pulse cycle time "to": ti/(ti+to)) of 30%. At this time, the maximum point of the electric field (minimum point of the magnetic field) is, theoretically, located at a position λg/4 distant from the iris unit 22 (a position −λg/4 distant from the maximum point of the magnetic field). However, when the substrate 24 is set, wavelength shortening occurs in the microwave moving within the substrate, and thus, the resonance position is moved. Therefore, a microwave detector was arranged at the minimum point of the electric field, λg/2 distant from the iris unit 22, and the position of the plunger was fine-adjusted at a position where the voltmeter located within the waveguide and connected to the microwave detector showed a minimal voltage value.

The surface temperature of the copper oxide after the heating time of 90 seconds, measured by the radiation thermometer, exceeded 250° C., and a copper film could be formed on the surface of the substrate while the substrate could be prevented from being broken. The obtained copper film had a thickness of 7 μm and a volume resistivity of $2.6\times10^{-5}$ Ω·cm.

Example 3

In place of the silver (Ag) paste (DOTITE (registered trademark) FA-353N, Ag content: 69% by mass, manufactured by Fujikura Kasei Co., Ltd.), 7 g of silver (Ag) paste (DOTITE (registered trademark) FA-353N, manufactured by Fujikura Kasei Co., Ltd.) was added with 0.14 g of ultra fine artificial graphite powder (UF-G10, median particle diameter: 4.5 μm, manufactured by Showa Denko K.K.) and 0.4 g of terpineol, and mixed well, and the resulting mixed paste was used. Other conditions were the same as those of Example 1, and the mixed paste was coated on the substrate. The microwave heating was performed in the same way as in Example 1. As a result, no sparks were generated during the microwave heating, and a silver film could be formed on the surface of the substrate while the substrate could be prevented from being broken. The obtained silver film had a thickness of 14 μm and a volume resistivity of $8.9\times10^{-5}$ Ω·cm.

Example 4

In place of the silver (Ag) paste (DOTITE (registered trademark) FA-353N, Ag content: 69% by mass, manufactured by Fujikura Kasei Co., Ltd.), 7 g of silver (Ag) paste (DOTITE (registered trademark) FA-353N, manufactured by Fujikura Kasei Co., Ltd.), was added with 0.7 g of ultra fine artificial graphite powder (UF-G10, median particle diameter: 4.5 μm, manufactured by Showa Denko K.K.) and 1.1 g of terpineol, and mixed well, and the resulting mixed paste was used. Other conditions were the same as those of Example 1, and the mixed paste was coated on the substrate. The microwave heating was performed in the same way as in Example 1. As a result, no sparks were generated during the microwave heating, and a silver film could be formed on the surface of the substrate while the substrate could be prevented from being broken. The obtained silver film had a thickness of 13 μm and a volume resistivity of $2.7\times10^{-4}$ Ω·cm.

Example 5

In place of the copper oxide paste (Metalon ICI-020, manufactured by NovaCentrix) containing the reducing agent (ethylene glycol), 1 g of copper oxide paste (Metalon ICI-020, manufactured by NovaCentrix) containing the reducing agent (ethylene glycol) was mixed with 1 g of silver paste (Metalon HPS-Series, High Performance Silver Inks, silver content being 50 to 90% by mass, diethylene glycol monobutyl ether content being 2 to 15% by mass, manufactured by NovaCentrix), and the resulting paste was coated. The obtained film after being dried for one day at a room temperature, had a thickness of 8 μm. The microwave heating was performed in the same way as in Example 2. As a result, a copper/silver film could be formed on the surface of the substrate while the substrate could be prevented from being broken. The obtained copper/silver film had a thickness of 7 μm and a volume resistivity of $1.8\times10^{-5}$ Ω·cm.

Example 6

As for the substrate, in place of the polyimide film, Kapton (registered trademark) 150EN (film thickness: 37.5 μm), manufactured by Du Pont-Toray Co., Ltd., a glass substrate (EAGLE XG, manufactured by Corning Incorporated) was used. In place of the silver (Ag) paste (DOTITE (registered trademark) FA-353N, Ag content: 69% by mass, manufactured by Fujikura Kasei Co., Ltd.), 1 g of indium tin oxide nanoparticles (median particle diameter: 50 nm, manufactured by Sigma-Aldrich) were added with 4 g of ethylene glycol (manufactured by Wako Pure Chemical Industries, Ltd.) and mixed well, and the resulting paste was used. Other conditions were the same as those of Example 1, and the mixed paste was coated on the substrate. The obtained film after being dried for one day at 50° C., had a thickness of 4 μm. The microwave heating was performed in the same way as in Example 1. As a result, no sparks were generated during the microwave heating, and an indium tin oxide film could be formed on the surface of the substrate while the substrate could be prevented from being broken. The obtained indium tin oxide film had a thickness of 3 μm and a volume resistivity of $8.3\times10^{-2}$ Ω·cm.

Example 7

As for the substrate, in place of the polyimide film, Kapton (registered trademark) 150EN, manufactured by Du Pont-Toray Co., Ltd., SHORAYAL (registered trademark, heat resistant film, manufactured by Showa Denko K.K.) was used. Other conditions were the same as those of Example 1, and the microwave heating was performed in the same way as in Example 1. As a result, a silver film could be formed on the surface of the substrate while the substrate could be prevented from being broken. The obtained silver film had a thickness of 5 μm and a volume resistivity of $3.9\times10^{-5}$ Ω·cm.

Example 8

As for the substrate, in place of the polyimide film, Kapton (registered trademark) 150EN, manufactured by Du Pont-Toray Co., Ltd., Teonex (registered trademark, polyethylene naphthalate film, manufactured by Teijin DuPont Films Japan Limited) was used. Other conditions were the same as those of Example 1, and the microwave heating was performed in the same way as in Example 1. As a result, a silver film could be formed on the surface of the substrate while the substrate could be prevented from being broken. The obtained silver film had a thickness of 5 μm and a volume resistivity of $4.6\times10^{-5}$ Ω·cm.

Example 9

As for the substrate, in place of the polyimide film, Kapton (registered trademark) 150EN, manufactured by Du Pont-Toray Co., Ltd., TORELINA (registered trademark, polyphenylene sulfide film, manufactured by Toray Industries, Inc.) was used. Other conditions were the same as those of Example 1, and the microwave heating was performed in the same way as in Example 1. As a result, a silver film could be formed on the surface of the substrate while the substrate could be prevented from being broken. The obtained silver film had a thickness of 5 μm and a volume resistivity of $4.3\times10^{-5}$ Ω·cm.

A microwave heating apparatus according to the present embodiment is provided with: a waveguide; a microwave supplying device which supplies a microwave so that the direction of the electrical flux line of the microwave is identical with the direction substantially parallel with a surface of a plate-like substrate having thereon a pattern containing a conductor, a metal oxide, or a semiconductor, the substrate being arranged in the waveguide; and a control device which controls a pulse width of the microwave supplying device so that pulsed microwaves are supplied to the surface having the pattern thereon.

A plurality of waveguides may be arranged in parallel with the traveling direction of the microwave, and juxtaposed in the direction perpendicular to the travelling direction of the microwave, so that the phases of the microwaves in the adjacent waveguides are maintained to be deviated 90 degrees. The microwave heating apparatus may comprise a substrate supplying device which supplies the substrate to sequentially pass through the plurality of waveguides.

Further, the microwave supplying directions may be alternate between adjacent waveguides in the plurality of waveguides.

In addition, the pattern may have a thickness of 10 nm to 100 μm, and formed on the substrate. The pattern may have a thickness of 10 nm to 10 μm.

Further, the apparatus may be provided with a function to move the substrate to pass through the inside of the waveguide, so that roll-to-roll microwave heating can be performed.

In addition, the present embodiment has the following features. Namely, an embodiment of the present disclosure is a conductive pattern forming method comprising a step for heating an ink pattern containing a conductor, a metal oxide, or a semiconductor and formed on a surface of a plate-like substrate.

Here, the ink pattern may contain carbon and metal as conductive materials. Also, the ink pattern may contain a metal oxide as a conductive material.

EXPLANATION ON NUMERALS

11 microwave source control unit
12 microwave generation unit
13 monitor unit
14 tuner unit
16 heating unit
18 to-be-heated object supplying unit
20 movable short circuit unit
20*a* tip portion
22 iris unit
22*a* tip portion
24 substrate
160, 161 waveguide

The invention claimed is:

1. A microwave heating apparatus provided with:

a rectangular waveguide which is provided on one side, in the microwave travelling direction, with an iris unit, and on the other side with a movable short circuit unit;

a microwave supplying device which supplies a microwave so that the direction of the electrical flux line of the microwave is in parallel with a surface of a substrate, or the angle between the direction of the electrical flux line of the microwave and the surface of the substrate is maintained within 30 degrees, the substrate having thereon a pattern containing a conductor, a metal oxide, or a semiconductor, the substrate being arranged in the waveguide; and a control device which controls a pulse width of the microwave supplying device so that pulsed microwaves are supplied to the surface having the pattern thereon.

2. The microwave heating apparatus according to claim 1 further comprising a substrate supplying device, wherein a plurality of waveguides are arranged in parallel with the traveling direction of the microwave, and juxtaposed in the direction perpendicular to the traveling direction of the microwave, so that the phases of the microwaves within the adjacent waveguides are maintained to be deviated 90 degrees, and the substrate supplying device supplies the substrate to pass through the plurality of waveguides sequentially.

3. The microwave heating apparatus according to claim 2, wherein the microwave supplying directions are alternate between the adjacent waveguides in the plurality of waveguides.

4. The microwave heating apparatus according to claim 1, wherein the pattern formed on the substrate has a thickness of 10 nm to 100 μm.

5. The microwave heating apparatus according to claim 4, wherein the pattern has a thickness of 10 nm to 10 μm.

* * * * *